United States Patent [19]

Kovaleski

[11] 3,972,489

[45] Aug. 3, 1976

[54] TENSION BRUSH WITH ADJUSTABLE BRAKE

[76] Inventor: Joseph J. Kovaleski, c/o Wyrepak Industries, Inc., 136 James St., Bridgeport, Conn. 06604

[22] Filed: May 16, 1975

[21] Appl. No.: 578,364

[52] U.S. Cl. ..... 242/128; 242/147 R

[51] Int. Cl.[2] ..... B65H 49/00; B65H 59/00

[58] Field of Search ..... 242/128, 129, 129.6, 242/129.8, 156.2, 147 R

[56] References Cited

UNITED STATES PATENTS

| | | | |
|---|---|---|---|
| 2,479,826 | 8/1949 | Frick et al. | 242/128 |
| 3,425,647 | 2/1969 | Kovaleski | 242/128 |
| 3,434,677 | 3/1969 | Hannis et al. | 242/128 |

*Primary Examiner*—Leonard D. Christian
*Attorney, Agent, or Firm*—H. Gibner Lehmann; K. Gibner Lehmann

[57] ABSTRACT

A take-off device for unreeling wire from a spool with a minimum of looseness and kinking, comprising a support, means for mounting the support at one end of a wire-carrying spool, a take-off wheel rotatably carried for free turning by the support and disposed in a plane perpendicular to the axis of the spool, a tension brush assembly comprising a plurality of radially extending tines disposed adjacent a peripheral flange of the wheel and adapted to be engaged and flexed by a strand of wire as it unreels from the spool, and cooperable braking means on the support and wheel for imparting a drag force to the latter as it rotates under the action of the unreeling wire. The support includes a spindle, which in turn carries a ball bearing having inner and outer races. The inner race remains stationary with the spindle while the outer race is secured to the hub of the wheel to enable the latter to have rotation about the spindle axis. Part of the spindle is threaded and carries a threaded washer which bears against a second, yieldable washer. The latter in turn engages the end faces of the inner and outer races, thus tending to limit relative turning movement between the two. As a result, a small drag force is imparted to the wheel, which has the effect of slowing its speed during fast unreeling so as to effect a more rapid halting thereof when the wire is slowed or stopped. The arrangement is such that the amount of drag imparted to the wheel can be effectively adjusted in order to enable the wheel speed to be related to differing wire take-off speeds.

8 Claims, 4 Drawing Figures

TENSION BRUSH WITH ADJUSTABLE BRAKE

CROSS-REFERENCES TO RELATED APPLICATIONS

Copending application of Joseph J. Kovaleski, U.S. Ser. No. 563,787 filed Mar. 31, 1975, and entitled TENSION BRUSH FOR WIRE SPOOL AND METHOD FOR MAKING THE SAME.

BACKGROUND

This invention relates to equipment for facilitating the removal of reeled wire from wire-carrying spools.

In the past a number of unreeling devices have been proposed and produced, one such device being disclosed in applicant's U.S. Pat. No. 3,425,647 issued Feb. 4, 1969, showing a rotatable disk or wheel carried at one end of a wire-carrying spool, together with a brush consisting of multiple, radially extending flexible tines adjacent peripheral portions of the wheel. In the above construction, the brush is held stationary with respect to the spool, while the wheel is freely rotatable under the action of the unreeling wire.

Under such circumstances, as wire is removed from the reel it brushes by the periphery of the freely rotatable wheel and past the radially extending tines of the tension brush. Due to the frictional engagement between the wire and the flange of the wheel, the latter gradually increases its rate of rotation as the wire take-off speed is increased.

It has been found that under certain conditions, the speed of the wheel increases to a point in excess of that desired to provide uniform dereeling of wire. In addition, in cases where the wire speed is abruptly halted the inertia of the rotating wheel is often sufficient to keep it rotating for a short interval of time beyond such halting. This momentary rotation tends to unravel several additional turns of wire from the reel, thus resulting in an undesirable looseness of the strands.

Still other arrangements involved the use of a stationary tension brush together with a positively driven wheel wherein the speed of the wheel could be changed to suit different conditions of wire size and wire take-off speed. While such arrangements provided a satisfactory solution to the problem of controlling the speed of the wheel, they tended to be relatively expensive and cumbersome, involving electric motors and control circuits therefor in order to provide the necessary adjustability in rotary speed. In addition, such prior devices were not capable of quick assembly to the spool. Thus, their flexibility was often rather limited.

SUMMARY

The above disadvantages and drawbacks of prior wire control devices are obviated by the present invention, which has for an object the provision of a novel and improved wire take-off device for use with wire carrying spools, which is simple in construction, reliable in its operation, and provides greatly improved results with wire of widely varying sizes and with variable take-off speeds. A related object is the provision of a device as above, wherein the assembly to the spool is readily accomplished. As a result, improved flexibility is realized while still maintaining extremely low overall cost. The construction is characterized by great economy, and has been found to provide maintainance-free operation over extended periods of use, as well as being very effective in preventing looseness and kinking of unreeling wire when the take-off speed is being reduced, or when the wire is being halted.

The above objects are accomplished by the provision of a take-off device for use in unreeling wire from a spool, comprising a support, means for carrying the support at a free end of the spool, a take-off wheel rotatably carried by the support coaxial with the spool and extending radially to the rim portion of one of the spool ends, a plurality of radially disposed, flexible tines adjacent the periphery of the wheel, and simple cooperable braking means on the support and the wheel for imparting a drag force to the latter as it rotates under the action of the wire. The braking means includes a manually operable adjustment for varying the magnitude of the drag force in order to enable the wheel speed to be related to differing wire take-off speeds. Such an arrangement provides a unique and effective control of the speed of the wheel, and has been found to provide significantly improved performance with wire of widely varying sizes and with differing take-off speeds. The provision of the braking means operates to reduce the speed of the wheel under conditions of relatively fast take-off, and in addition tends to provide a more abrupt halting of the wheel in the event that the wire speed is reduced. As a result, excessive unreeling is greatly minimized following such a reduction in wire speed.

Other features and advantages will hereinafter appear.

Figure 1:
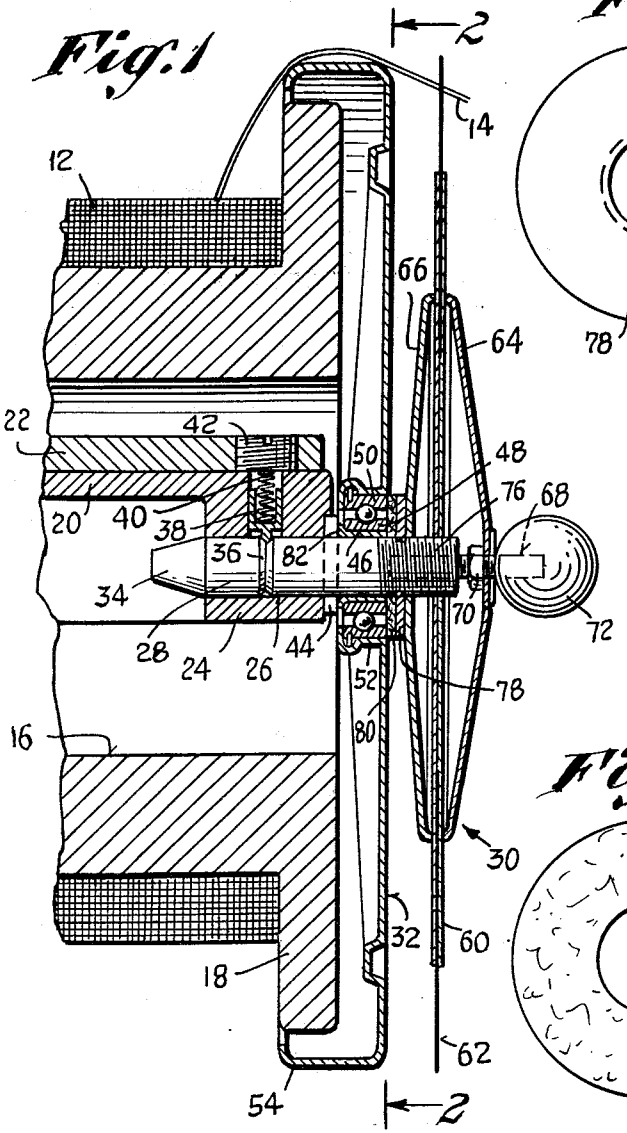
FIG. 1 is an axial sectional view of a wire-carrying spool incorporating the improved wire take-off device of the present invention.

Referring to FIG. 1, there is illustrated a spool having a flange 18 and carrying a quantity of wire 12, including a strand 14 extending therefrom. The spool is carried by a suitable arm or mounting device which extends through the bore 16 and engages circumferentially spaced points thereon, the mounting device comprising a horizontal member 20 having an upper plate 22 and an end wall 24. The latter has an aperture 26 in which there is received a support or spindle 28 carrying a tension brush 30 and a rotatable wheel 32. As shown, the spindle has a tapered nose portion 34, and a transverse groove 36. The latter is adapted to be engaged by a spring biased cup 38. The spring is designated 40, and is held in place by means of a cap screw 42. The spindle further includes a transverse pin 44 which constitutes a spacer between the end wall 24 and a bushing 46. Carried on the latter is a ball bearing having inner and outer races or rings 48, 50 respectively, the outer race or ring being pressed into the hub 52 of the wheel 32. A C-shaped peripheral flange 54 on the wheel extends over the flange 18 of the spool as shown, but is spaced therefrom.

Referring again to FIG. 1, also carried by the spindle 28 is the tension brush 30 which comprises a body 60 of substantially circular outline, having a plurality of radially extending tines 62 disposed adjacent the peripheral flange 54 of the wheel. The body 60 is clamped in place by means of support plates 64, 66. Received in the end of the spindle 28 is a threaded shaft 68 carrying a mounting nut 70, and knob 72. The latter facilitates grasping of the assemblage consisting of the spindle wheel 32, and tension brush 30. The nut 70 is tightened against the knob 72 to thereby secure the support plate 64 in position. By such an arrangement, it will be seen that as the strand 14 leaves the spool of wire 12, it will impart turning movement to the wheel 32, and simultaneously will brush past the radially extending tines 62. The latter are adapted to impart a slight drag to the strand, in order to hold it in a fixed position when the wire speed is reduced or halted.

Figure 2:
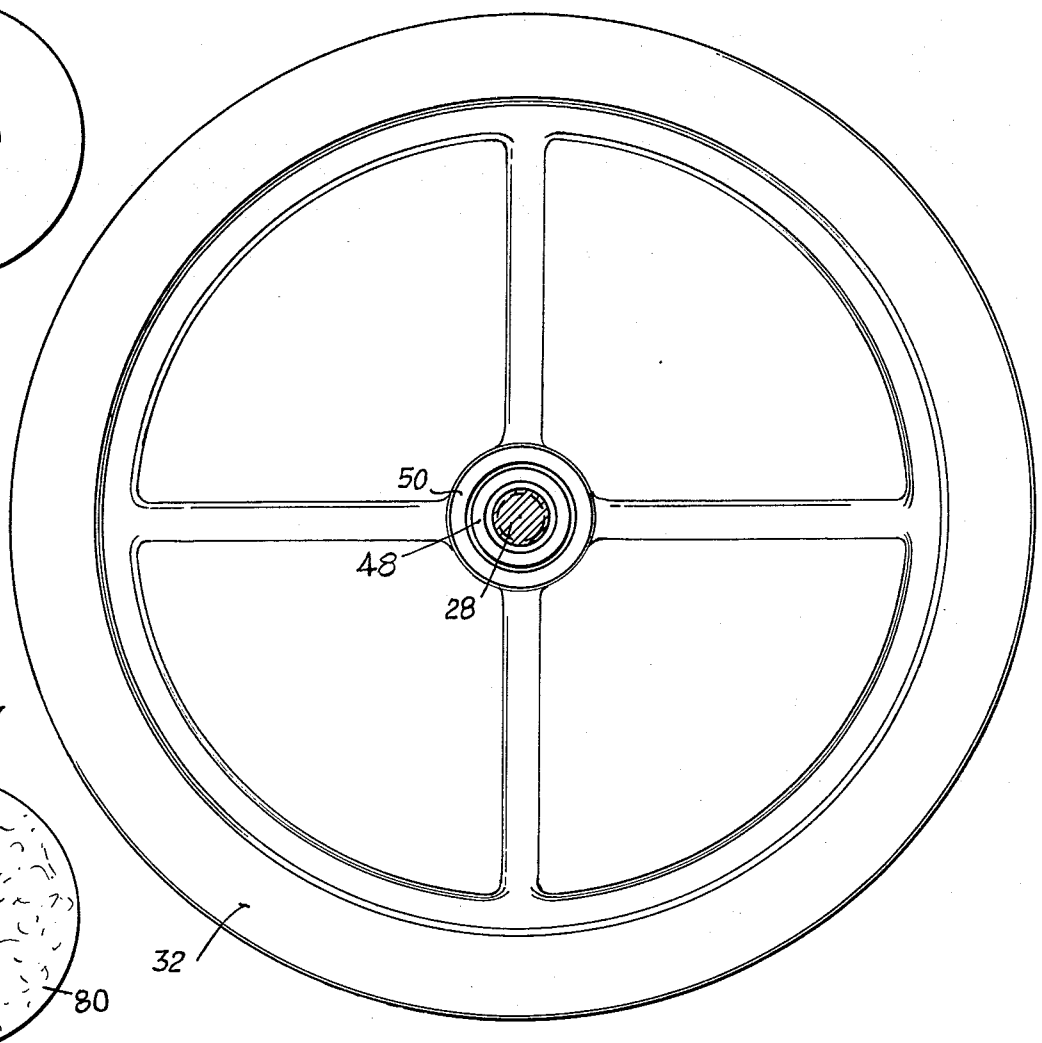
FIG. 2 is a vertical section taken on line 2—2 of FIG. 1.
Figure 3:
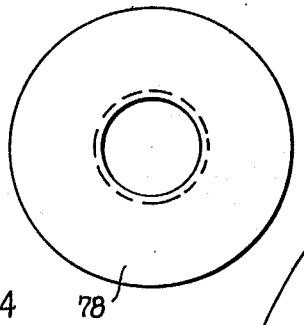
FIG. 3 is a plan view of a threaded washer as employed in the braking mechanism for the wheel portion of the take-off device in FIG. 1.
Figure 4:
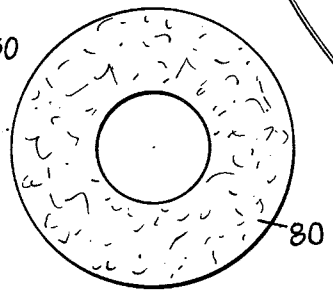
FIG. 4 is a plan view of a washer as employed in the braking mechanism for the wheel of FIG. 1.

In accordance with the present invention, there is provided a novel braking means on the spindle 28 and wheel 32, for imparting a drag force to the latter as it rotates under the action of the wire. As shown, a portion of the spindle 28 is threaded, and designated by the numeral 76 in FIG. 1. Carried by the threaded portion 76 is an adjustment nut or threaded washer 78 and a yieldable felt washer 80. The latter has a sufficient diameter in order to be capable of simultaneous engagement with the end faces of both the inner and outer races 48, 50 respectively of the bearing. The inner race is held in a fixed axial position by a shoulder 82 on the bushing 46, and is stationary with respect to the spindle 28; since the outer race 50 is rigid with and rotates with the wheel 32, the engagement of the races by the felt washer 80 is seen to impart a slight amount of frictional drag between the two. Adjustment of the threaded washer 78 results in variation in the pressure exerted by the felt washer 80 against the adjacent faces of the races 48, 50, thereby effecting adjustment in the magnitude of the drag force imparted to the wheel 32. Such an arrangement has been found to be highly desirable, in order to limit the free-wheeling speed of the wheel 32, as well as to improve the response of the device to an abrupt reduction in the wire take-off speed. During such halting, the brake slows the wheel promptly, thereby reducing its tendency to unravel additional turns of wire. FIGS. 3 and 4 respectively show washers 78, 80.

The entire device is seen to be extremely simple in construction. Assembly of the tension brush 30 and wheel 32 to the spool is accomplished by inserting the nose portion 34 of the spindle 28 into the aperture 26 until the cup 38 snaps into the transverse groove 36. Removal of the tension brush assembly and wheel is readily accomplished in a similar manner. The above organization has been found to provide improved performance with wires of widely varying diameters, as well as with wire take-off speeds over a wide range of values. Adjustment of the absolute magnitude of the drag force imparted to the wheel is readily accomplished merely by tightening the threaded washer 78. The washer 80 may be constituted of felt or other relatively soft material, and has been found to provide excellent uniformity and performance over prolonged periods of use. The device is thus seen to represent a distinct advance and improvement in the technology of wire take-off devices.

Variations and modifications are possible without departing from the spirit of the invention.

I claim:

1. A take-off device for use in unreeling wire from a spool without excessive looseness or kinking, comprising in combination:

a. a support, b. means for mounting the support on a free end of a spool containing wire, c. a take-off wheel rotatably carried by said support, said wheel being coaxial with and adjacent said free end of the spool and extending radially at least to the rim portion of said one spool end, to be engaged and rotated by wire which is unreeled from the spool past said end, d. a plurality of substantially radially disposed, flexible, slender spoke-like wire-restraining tines fixedly supported at their inner ends on said support adjacent the axis of said wheel and extending generally radially outward alongside the wheel and past the periphery thereof, the outer end portions of said tines yielding to and being shifted peripherally by the unreeling wire, said wire being thereby restrained from wholly free travel around the periphery of the spool end and being prevented from freely unwinding around the spool end and kinking during slow wire speeds or halting of the wire, and e. cooperable braking means on said support and wheel for imparting a drag force to the latter as it rotates under the action of the wire, said means comprising a ring turnable with the wheel and an adjoining ring fixed with respect to the support, and a common brake washer having a single brake facing engaging said rings simultaneously and further including a manually operable adjustment for varying the magnitude of said drag force in order to enable the wheel speed to be related to differing wire take-off speeds.

2. A take-off device for use in unreeling wire from a spool without excessive looseness or kinking, comprising in combination:

a. a support, b. means for mounting the support on a free end of a spool containing wire, c. a take-off wheel rotatably carried by said support, said wheel being coaxial with and adjacent said free end of the spool and extending radially at least to the rim portion of said one spool end, to be engaged and rotated by wire which is unreeled from the spool past said end, d. a plurality of substantially radially disposed, flexible, slender spoke-like wire-restraining tines fixedly supported at their inner ends on said support adjacent the axis of said wheel and extending generally radially outward alongside the wheel and past the periphery thereof, the outer end portions of said tines yielding to and being shifted peripherally by the unreeling wire, said wire being thereby restrained from wholly free travel around the periphery of the spool end and being prevented from freely unwinding around the spool end and kinking during slow wire speeds or halting of the wire, and e. cooperable braking means on said support and wheel for imparting a drag force to the latter as it rotates under the action of the wire, said means including a manually operable adjustment for varying the magnitude of said drag force in order to enable the wheel speed to be related to differing wire take-off speeds, f. said support comprising a spindle, g. said cooperable braking means comprising a bearing disposed on the spindle and rotatably mounting the wheel, h. said bearing comprising inner and outer races adapted to rotate with respect to one another, said outer race being rigid with said wheel, said inner race being carried on said spindle, and i. yieldable means frictionally engaging adjacent faces of said races, tending to slow down relative turning movement therebetween.

3. The invention as defined in claim 2, wherein:

a. said spindle has a threaded portion, b. a nut carried by said threaded portion, and c. a flexible washer also carried by the threaded portion and adapted to engage end faces of said races, in response to pressure applied by said nut, said washer constituting the yieldable means.

4. The invention as defined in claim 3, wherein:

a. said nut is constituted as a threaded washer.

5. The invention as defined in claim 3, wherein:

a. said flexible washer is constituted of felt.

6. The invention as defined in claim 3, and further including:

a. a shouldered bushing carried by the spindle and providing a backing for said inner race, against the pressure applied by said nut.

7. A take-off device for use in unreeling wire from a spool without excessive looseness or kinking, comprising in combination:

a. a support, b. means for mounting the support on a free end of a spool containing wire, c. a take-off wheel rotatably carried by said support, said wheel being coaxial with and adjacent said free end of the spool and extending radially at least to the rim portion of said one spool end, to be engaged and rotated by wire which is unreeled from the spool past said end, d. a plurality of substantially radially disposed, flexible, slender spoke-like wire-restraining tines fixedly supported at their inner ends on said support adjacent the axis of said wheel and extending generally radially outward alongside the wheel and past the periphery thereof, the outer end portions of said tines yielding to and being shifted peripherally by the unreeling wire, said wire being thereby restrained from wholly free travel around the periphery of the spool end and being prevented from freely unwinding around the spool end and kinking during slow wire speeds or halting of the wire, and e. cooperable braking means on said support and wheel for imparting a drag force to the latter as it rotates under the action of the wire, said means including a manually operable adjustment for varying the magnitude of said drag force in order to enable the wheel speed to be related to differing wire take-off speeds, f. said mounting means comprising an arm extending into the bore of the spool and engaging circumferentially spaced points thereon, g. said arm comprising an end plate having an aperture to receive the support, and h. snap retainer means carried by said end plate for releasably securing the support thereto.

8. The invention as defined in claim 2, and further including:

a. manually engageable means on said support for enabling the latter to be readily grasped by the operator.

* * * * *